United States Patent [19]

Terauchi

[11] Patent Number: 4,642,034

[45] Date of Patent: Feb. 10, 1987

[54] SCROLL TYPE COMPRESSOR WITH DISPLACEMENT ADJUSTING MECHANISM

[75] Inventor: Kiyoshi Terauchi, Isesaki, Japan

[73] Assignee: Sanden Corporation, Isesaki, Japan

[21] Appl. No.: 669,389

[22] Filed: Nov. 8, 1984

[30] Foreign Application Priority Data

Nov. 8, 1983 [JP] Japan ..... 58-208356[U]

[51] Int. Cl.[4] ..... F04B 49/02; F04C 18/02; F04C 29/10

[52] U.S. Cl. ..... 417/295; 417/299; 417/310; 417/441; 418/55

[58] Field of Search ..... 418/55; 417/285, 295, 417/310, 440, 441, 299

[56] References Cited

U.S. PATENT DOCUMENTS

| | | | |
|---|---|---|---|
| 2,350,537 | 6/1944 | Scott | 417/295 X |
| 3,253,607 | 5/1906 | Drutchas | 417/310 X |
| 3,367,562 | 2/1968 | Persson et al. | 417/295 |
| 3,759,037 | 9/1973 | English et al. | 417/440 X |
| 3,953,153 | 4/1976 | Huber et al. | 417/310 X |
| 4,468,178 | 8/1984 | Hiraga et al. | 418/55 X |
| 4,498,848 | 2/1985 | Petrovsky et al. | 417/295 X |
| 4,505,651 | 3/1985 | Terauchi et al. | 417/440 |
| 4,566,863 | 1/1986 | Goto et al. | 417/295 |

*Primary Examiner*—Carlton R. Croyle
*Assistant Examiner*—Theodore W. Olds
*Attorney, Agent, or Firm*—Banner, Birch, McKie & Beckett

[57] ABSTRACT

A scroll type compressor is disclosed which includes a housing with an inner chamber and fluid inlet and outlet ports connected to the inner chamber. A fixed scroll, which is mounted within the housing, has a circular end plate from which a first spiral wrap extends. An orbiting scroll also is mounted within the housing for orbital motion with respect to the fixed scroll. The orbiting scroll has a circular end plate from which a second spiral wrap extends; the first and second wraps interfit to define at least one pair of sealed off fluid pockets. The end plate of the fixed scroll partitions the inner chamber of the housing into a suction chamber and rear chamber. The rear chamber is divided into a discharge chamber and an intermediate pressure chamber. The circular end plate of the fixed scroll has at least one pair of holes symmetrically positioned to connect the sealed off fluid pockets to the intermediate pressure chamber. A control mechanism selectively controls fluid communication between the suction chamber and the intermediate pressure chamber to adjust the volume displacement and compression ratio of the scroll type compressor. This control mechanism also controls the resistance of the scroll type compressor to suction in conjunction with the control of fluid communication between the suction and intermediate chambers in order to maximize the amount of adjustment of the volume displacement and compression ratio.

5 Claims, 4 Drawing Figures

SCROLL TYPE COMPRESSOR WITH DISPLACEMENT ADJUSTING MECHANISM

BACKGROUND OF THE INVENTION

This invention relates to a scroll type compressor, and more particularly, to a scroll type compressor for an automobile air conditioning system which includes a mechanism for adjusting the displacement of the compressor.

Scroll type fluid displacement apparatus are well known in the prior art. For example, U.S. Pat. No. 801,182 issued to Creux discloses such an apparatus which includes two scrolls, each having a circular end plate and a spiroidal or involute spiral element. The scrolls are maintained angularly and radially offset so that both spiral elements interfit to form a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets increases or decreases, dependent on the direction of the orbital motion. Thus, a scroll type fluid displacement apparatus may be used to compress, expand or pump fluids.

Scroll type fluid displacement apparatus are suitable for use as refrigerant compressors in building air conditioners. In such building air conditioners, thermal control of a room, or control of the air conditioner, is generally accomplished by intermittent operation of the compressor because capacity control mechanisms usually are not provided for the compressors of such air conditioners. Though the energy required for maintaining the room at the desired temperature usually is not large once the desired temperature is first achieved, a relatively large load is required to drive the compressor at least during initial intermittent operation of the compressor and to a lesser extent upon each subsequent actuation of the compressor. This intermittent operation wastefully consumes large amounts of energy.

When conventional scroll type compressors are used in automobile air conditioners, these compressors usually are driven by the automobile engine through an electromagnetic clutch. Once the passenger compartment is cooled to the desired temperature, like building air conditioners, control of the output of the compressor usually is accomplished by intermittent operation of the compressor through the electromagnetic clutch. Since a relatively large load is required to drive the compressor, this large load is intermittently applied by the automobile engine. Accordingly, conventional scroll type compressors for automobile air conditioners also wastefully consume large amounts of energy in achieving and maintaining the desired temperature in the passenger compartment.

Recently, it was recognized that it is desirable to provide a scroll type compressor with a displacement or volume adjusting mechanism to control the compression ratio in response to demand. In a scroll type compressor, control of the compression ratio can be easily accomplished by controlling the volume of the sealed off fluid pockets as disclosed in U.S. Pat. No. 4,505,651 issued 3/19/85 to Kiyoshi Terauchi et al. This application discloses a mechanism for controlling the volume of the sealed off fluid pockets which includes a pair of holes formed through the end plate of one of the scrolls. These holes directly connect intermediate fluid pockets between the scrolls to an intermediate chamber. This intermediate chamber is connected with the suction chamber through another communicating channel or hole. The opening and closing of the communicating channel or hole is controlled by an electrically operated valve member disposed in the intermediate chamber.

While the mechanism disclosed in the above mentioned application controls the compression ratio, and significantly improves the operation of conventional scroll type compressors, this mechanism has not provided a sufficiently wide range of adjustment of compression ratios.

SUMMARY OF THE INVENTION

It is a primary object of this invention to improve the operation of a scroll type compressor by incorporating a mechanism for changing the compression ratio of the compressor in response to demand without wasteful consumption of energy.

It is another object of this invention to provide a scroll type compressor in which the volume reduction ratio of the fluid pockets can be freely selected in response to demand without unnecessary operation of the compressor.

It is still another object of this invention to provide a scroll type compressor in which the fluid pockets remain sealed while achieving the above objects.

A scroll type compressor according to this invention includes a housing having a fluid inlet port and a fluid outlet port. A fixed scroll is fixedly disposed in the housing and has a circular end plate from which a first wrap extends. An orbiting scroll has a circular end plate from which a second wrap extends. The first and second wraps interfit at an angular and radial offset to form a plurality of line contacts to define at least one pair of sealed off fluid pockets. A driving mechanism is operatively connected to the orbiting scroll to effect the orbital motion of the orbiting scroll by rotation of a drive shaft while rotation of the orbiting scroll is prevented by a rotation preventing device. As a result, the fluid pockets shift along the spiral curved surfaces of the wraps which change the volume of the fluid pockets.

According to the present invention, one of the circular end plates has at least one pair of holes formed therein. The holes are placed in symmetrical positions so that the wrap of the other scroll simultaneously crosses over both holes and connects the sealed off fluid pockets to an intermediate pressure chamber. A communicating channel or hole is formed through the same end plate having the pair of holes and this communicating channel is located at the outer side of the terminal end of the wrap for communication between a suction chamber and the intermediate pressure chamber. The opening and closing of the communicating channel is controlled by a control device. Additionally, a throttle mechanism, which is disposed between the fluid inlet port and the suction chamber, operates in conjunction with the operation of the control device to increase the suction resistance during the initial opening of the communicating channel by the control device.

Further objects, features and other aspects of this invention will be understood from the detailed description of the preferred embodiment of this invention with reference to the annexed drawings.

DETAILED DESCRIPTION OF THE PREFERRED EMBODIMENT

Figure 1:
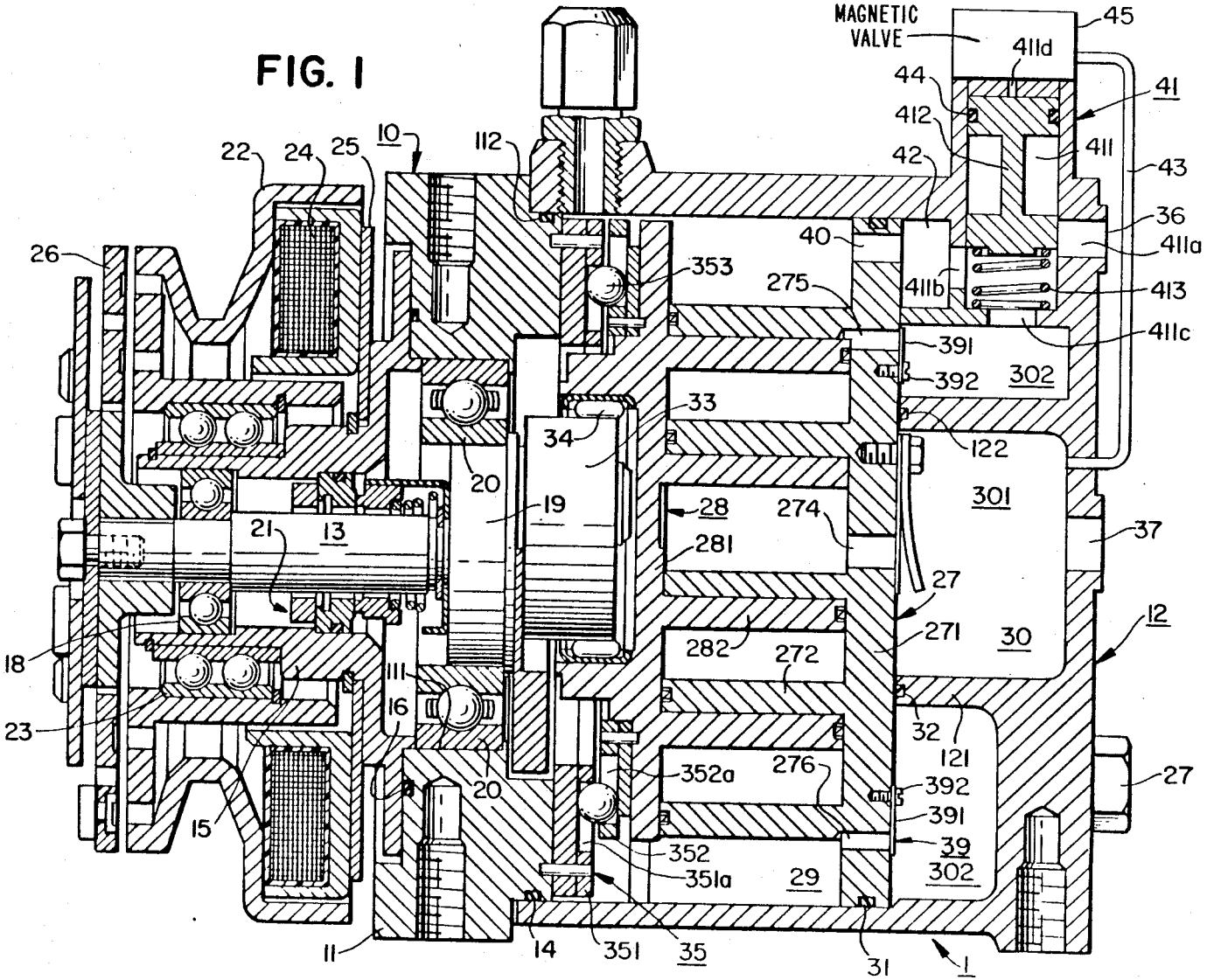
FIG. 1 is a vertical longitudinal sectional view of a scroll type compressor in accordance with one embodiment of this invention.

Referring to FIG. 1, scroll type refrigerant compressor 1 in accordance with an embodiment of the present invention is shown. Compressor 1 includes compressor housing 10 having front end plate 11 and cup shaped casing 12 which is attached to an end surface of front end plate 11. Opening 111 is formed in the center of front end plate 11 for penetration or passage of drive shaft 13. Annular projection 112 is formed in a rear end surface of front end plate 11. Annular projection 112 faces cup shaped casing 12 and is concentric with opening 111. An outer peripheral surface of annular projection 112 extends into an inner wall of the opening of cup shaped casing 12. Thus, the opening of cup shaped casing 12 is covered by front end plate 11. O-ring 14 is placed between the outer peripheral surface of annular projection 112 and the inner wall of the opening of cup shaped casing 12 to seal the mating surface of front end plate 11 and cup shaped casing 12.

Annular sleeve 15 projects from the front end surfaces of front end plate 11 to surround drive shaft 13 and define a shaft seal cavity. In the embodiment shown in FIG. 1, sleeve 15 is formed separately from front end plate 11. Therefore, sleeve 15 is fixed to the front end surface of front end plate 11 by screws (not shown). O-ring 16 is disposed between the end surface of sleeve 15 and the front end surface of front end plate 11 to seal the mating surface of front end plate 11 and sleeve 15. Alternatively, sleeve 15 may be formed integral with front end plate 11.

Drive shaft 13 is rotatably supported by sleeve 15 through bearing 18 located within the front end of sleeve 15. Drive shaft 13 has disk shaped rotor 19 at its inner end which is rotatably supported by front end plate 11 through bearing 20 located within opening 111 of front end plate 11. Shaft seal assembly 21 is coupled to drive shaft 13 within the shaft seal cavity of sleeve 15.

Pulley 22 is rotatably supported by bearing 23 which is carried on the outer surface of sleeve 15. Electromagnetic coil 24 is fixed about the outer surface of sleeve 15 by support plate 25 and is received in an annular cavity of pulley 22. Armature plate 26 is elastically supported on the outer end of drive shaft 13 which extends from sleeve 15. Pulley 22, magnetic coil 24 and armature plate 26 form a magnetic clutch. In operation, drive shaft 13 is driven by an external power source, for example the engine of an automobile, through a rotation transmitting device such as the above explained magnetic clutch.

A number of elements are located within the inner chamber of cup shaped casing 12 including fixed scroll 27, orbiting scroll 28, a driving mechanism for orbiting scroll 28 and rotation preventing/thrust bearing device 35 for orbiting scroll 28. The inner chamber of cup shaped casing 12 is formed between the inner wall of cup shaped casing 12 and the rear end surface of front end plate 11.

Fixed scroll 27 includes circular end plate 271 and wrap or spiral element 272 affixed to or extending from one end surface of end plate 271. Fixed scroll 27 is fixed within the inner chamber of cup shaped casing 12 by screws 27 screwed into end plate 271 from outside of cup shaped casing 12. Circular end plate 271 of fixed scroll 27 partitions the inner chamber of cup shaped casing 12 into two chambers, such as front chamber 29 and rear chamber 30. Seal ring 31 is disposed within a circumferential groove of circular end plate 271 to form a seal between the inner wall of cup shaped casing 12 and the outer surface of circular end plate 12. Spiral element 272 is located within front chamber 30.

Annular partition wall 121 axially projects from the inner end surface of cup shaped casing 12. The end surface of partition wall 121 contacts against the end surface of circular end plate 271. Seal ring 32 is located between the axial end surface of partition wall 121 and the end surface of circular end plate 271 to seal the contacting surface of circular end plate 271 and partition wall 121. Thus, partition wall 121 divides rear chamber 30 into discharge chamber 301 formed at the center portion of the rear chamber and intermediate pressure chamber 302 formed at the outer peripheral portion of rear chamber 30.

Orbiting scroll 28, which is located in front chamber 29 includes circular end plate 281 and wrap or spiral element 282 affixed to or extending from one end surface of circular end plate 281. Spiral elements 272 and 282 interfit at an annular offset of 180° and at a predetermined radial offset. Spiral elements 272 and 282 define at least one pair of sealed off fluid pockets between their interfitting surfaces. Orbiting scroll 28 is rotatably supported by bushing 33 through bearing 34 placed on the outer peripheral surface of bushing 33. Bushing 33 is connected to an inner end of disk shaped portion 19 at a point radially offset or eccentric of the axis of drive shaft 13. While orbiting scroll 28 orbits, the rotation of orbiting scroll 28 is prevented by rotation preventing/-thrust bearing device 35 which is placed between the inner end surface of front end plate 11 and the end surface of circular end plate 281. Rotation preventing/-thrust bearing device 35 includes fixed ring 351 attached on the inner end surface of front end plate 11, orbiting ring 352 attached on the end surface of circular end plate 282, and a plurality of bearing elements, such as balls 353, placed between pockets 351*a*, 352*a* formed by rings 351, 352. The rotation of orbiting scroll 28 during orbital motion is prevented by the interaction of balls 353 with rings 351, 352. Also, the axial thrust load from orbiting scroll 28 is supported on front end plate 11 through balls 353.

Cup shaped casing 12 has fluid inlet port 36 and fluid outlet port 37 for connecting the compressor to an external fluid circuit. Fluid from the external fluid circuit is introduced into front chamber 29 of the compressor through inlet port 36 and a valve device which is more fully explained below. Fluid in front chamber 29 is taken into the fluid pockets through open spaces between the outer terminal end of one of the spiral elements 272, 282 and the outer wall surface of the other spiral element. The entrances to these fluid pockets or open spaces sequentially open or close during the orbital motion of orbiting scroll 28. When the entrances to the fluid pockets are open, fluid to be compressed flows into these pockets but no compression occurs. When the entrances are closed, thereby sealing off the fluid pockets, no additional fluid flows into the pockets and compression begins. Since the location of the outer terminal end of each spiral element 272, 282 is at the final involute angle, the location of the fluid pockets is directly related to the final involue angle.

Figure 2:
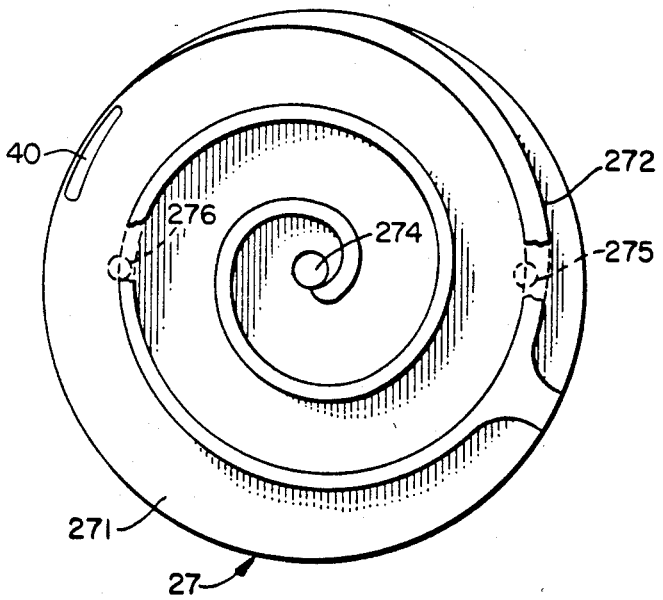
FIG. 2 is a front end view of the fixed scroll of the scroll type compressor of FIG. 1.

Referring to FIG. 2, the final involute angle ($\phi$ end) at the end of spiral element 272 of fixed scroll member 27 is greater than $4\pi$. At least one pair of holes 275 and 276 are formed in end plate 272 of fixed scroll 27 and are placed at symmetrical positions so that an axial end surface of spiral element 282 of orbiting scroll 28 simultaneously crosses over holes 275 and 276. Holes 275 and 276 communicate between the fluid pockets in front chamber 29 and intermediate pressure chamber 302 of rear chamber 30 as best shown in FIG. 1 and as further described in related U.S. Pat. No. 4,505,651 to K. Terauchi et al.

Hole 275 is placed at a position defined by involute angle $\phi_1$ and opens along the inner wall side of spiral element 272. The other hole 276 is placed at a position defined by the involute angle ($\phi_1-\pi$) and opens along the outer wall side of spiral element 272. The preferred area within which to place first hole 275, as defined by involute angle, is given by $\phi\text{end}>\phi_1>\phi\text{end}-2\pi$. The other hole 276 is located further from $\phi$end, i.e., at $\phi_1-\pi$.

Holes 275 and 276 are formed by drilling into end plate 271 from the side opposite from which spiral element 272 extends. Hole 275 is drilled at a position which overlaps with the inner wall of spiral element 272 so that a portion of the inner wall of spiral element 272 is removed. Hole 276 is also drilled at a position which overlaps the outer wall of spiral element 272 so that a portion of the outer wall of spiral element 272 is removed. In this arrangement, the axial end surface of each spiral element is provided with a seal element 38 which forms an axial seal between the spiral element and the facing end plate 271, 281. Holes 275, 276 are positioned so that they do not communicate with the fluid pockets between spiral elements 272, 282 when the spiral element completely overlaps the holes. This is accomplished by extending a portion of each hole of sufficient size into spiral element 272 so that seal element 38 in spiral element 282 remains completely in contact with end plate 271 when spiral element 282 completely overlaps holes 275, 276.

A control device, such as valve member 39 having valve plate 391, is attached by fastener 392 to the end surface of end plate 271 at holes 275, 276. Valve plate 391 is made of a spring type material so that the inherent spring of each valve plate 391 pushes it against the opening of respective holes 275, 276 to close each hole.

End plate 271 of fixed scroll 27 also includes communicating channel or hole 40 at the outer side portion of the terminal end of spiral element 272. Communicating channel 40 connects suction chamber 29 to intermediate pressure chamber 302. Control mechanism 41, which controls the opening and closing of communicating channel 40, is located in intermediate pressure chamber 302. Control mechanism 41, which is a three-way valve, includes cylinder 411, I-shaped piston 412 slidably disposed within cylinder 411 and coil spring 413 disposed between the lower end portion of piston 412 and the bottom portion of cylinder 411 to support piston 412. First opening 411*a* of cylinder 411 is connected with fluid inlet port 36 and second opening 411*b*, which faces first opening 411*a* but is slightly offset, is connected with communicating hole 40 through suction passageway 42. First opening 411*a* is located on cylinder 411 slightly above second opening 411*b*. A bottom portion of cylinder 411 communicates with intermediate pressure chamber 302 through fluid opening 411*c* and the upper portion of cylinder 411 includes aperture 411*d* which connects cylinder 411 with discharge chamber 301 through capillary tubing 43. Piston ring 44 is placed on the upper portion of piston 412 to prevent leakage of high pressure gas between cylinder 411 and piston 412. The opening and closing of aperture 411*d* is controlled by magnetic valve 45 as best shown in FIGS. 3*a* and 3*b*.

Figure 3A:
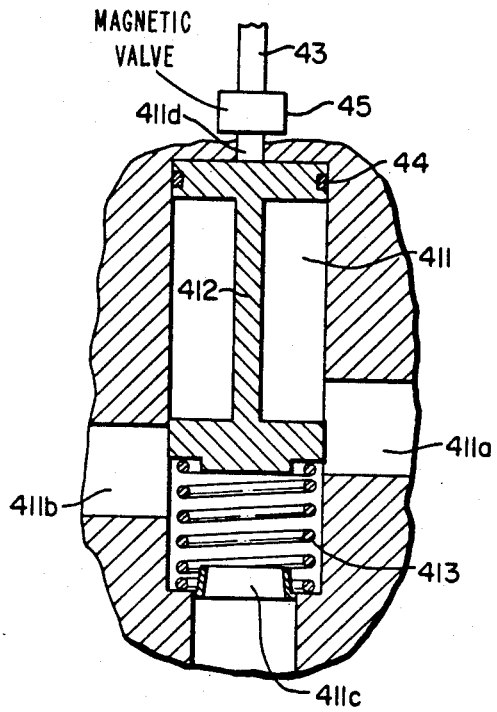
FIGS. 3*a* and 3*b* are schematic views illustrating the operation of the control device of the scroll type compressor of FIG. 1.
Figure 3B:
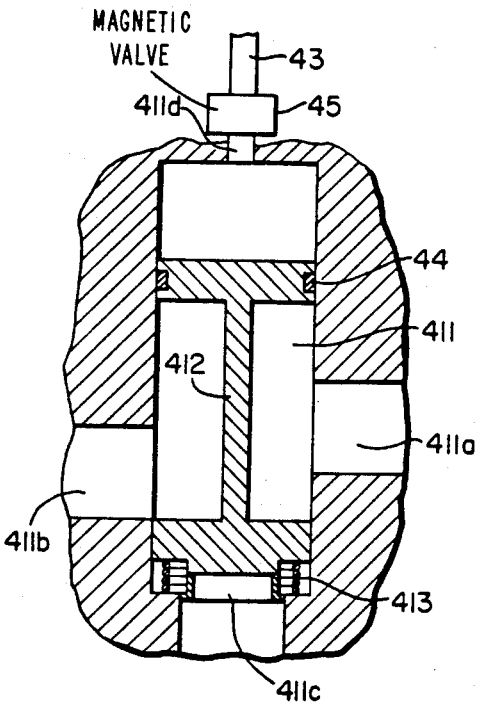

Referring now to FIGS. 3*a* and 3*b*, the operation of control mechanism 41 will now be described. When aperture 411*d* is closed by operation of magnetic valve 45, the flow of high pressure gas from discharge chamber 301 through capillary tubing 43 is prevented. Therefore, piston 412 is pushed against the upper surface of cylinder 411 by the recoil strength of coil spring 413, and the lower portion of piston 412 faces the lower portion of first opening 411*a*, as shown in FIG. 3*a*. In this situation, since the passageway between first opening 411*a* and piston 412 is narrow, pressure loss of suction gas introduced from first opening 411*a* occurs, and thus, the flow rate of suction gas is reduced. The fluid in cylinder 411 flows into suction chamber 29 and into the fluid pockets through suction passageway 42 and communicating channel 40. The fluid in the fluid pockets then moves toward the center of the spiral wraps during the orbital motion of the orbiting scroll with a resultant volume reduction and compression. However, intermediate pressure chamber 302 is connected to suction chamber 29 through fluid hole 411*c* and second hole 411*b*. Thus, compressed fluid in the fluid pockets leaks into suction chamber 29 through holes 275, 276 to fluid hole 411*c* to hole 411*b* to communication channel 40 connected to suction chamber 29. This leakage continues until the axial end surface of spiral element 272 crosses over holes 275, 276. During the above leakage or back flow, compression cannot occur because the volume of the fluid pockets, which were previously sealed from intermediate pressure chamber 302 when initial compression actually began, is reduced. Therefore, the compression ratio of the compressor is greatly reduced by the operation of control mechanism 41.

When aperture 411*d* is opened by operation of magnetic valve 45, the high pressure gas in discharge chamber 301 is introduced into the upper portion of cylinder 411 through capillary tubing 43. At that time, if the recoil strength of coil spring 413 is selected to be less than the pressure force of the high pressure gas, piston 412 will be pushed down by the pressure of the high pressure gas as shown in FIG. 3*b*. In this situation, first opening 411*a* is fully opened since the intermediate leg of piston 412 has a cross-sectional area significantly less than the cross-sectional area of cylinder 411. Therefore, suction gas introduced from first opening 411*a* flows into suction chamber 29 without the above described pressure loss. Furthermore, third opening 411*c* of cylinder 411 is closed by piston 412, i.e., communication between intermediate pressure chamber 302 and suction chamber 29 is blocked. Thus, the fluid in the fluid pockets moves to the center of the spiral wraps with a resultant volume reduction and compression, and is discharged into discharge chamber 301 through discharge hole 274.

At the initial stage of operation described above, the pressure in the fluid pockets increases above the pressure in intermediate pressure chamber 302. Therefore, valve plates 391 operate to open holes 275, 276 by virtue of the pressure difference between the fluid pockets and intermediate pressure chamber 302. Upon operation of valve plates 391, the fluid in the fluid pockets leaks back to intermediate pressure chamber 302 through holes 275, 276. This leakage continues until the pressure in the fluid pockets is equal to the pressure in intermediate pressure chamber 302. When pressure equalization occurs, holes 275, 276 are closed by the spring tension in valve plates 391 so that compression operates normally and the displacement volume when of the sealed off fluid pockets is the same as the displacement volume when the terminal end of each respective spiral wrap 272, 282 first contacts the outer spiral wrap.

In the latter condition, if aperture 411*d* is closed by operation of magnetic valve 45, the flow of the high pressure gas is prevented. The high pressure gas in the sealed off space between the upper portion of cylinder 411 and piston 412 then leaks to suction chamber 29 through a gap in piston ring 44. Piston 412 then is pushed up by the recoil strength of coil spring 413 to open third opening 411*c* of cylinder 411. Thus, the compression ratio of the compressor is again reduced.

As mentioned above, in this invention, a mechanism for adjustment of the displacement volume is provided that includes a valve to actually control the opening of the fluid inlet port. During the condition in which a narrow suction opening is provided by this mechanism, the fluid in the fluid pockets leaks into the suction chamber through a pair of holes in the end plate of the fixed scroll via an intermediate pressure chamber. Thus, by operation of the displacement volume adjustment mechanism of the present invention, great compression ratio adjustments can be realized.

This invention has been described in detail in connection with a preferred embodiment. This embodiment, however, is merely for example only and the invention is not restricted thereto. It will be easily understood by those skilled in the art that other variations and modifications can easily be made within the scope of this invention, as defined by the appended claims.

I claim:

1. In a scroll type fluid compressor including a housing having a fluid inlet port and a fluid outlet port, a fixed scroll fixedly disposed within said housing and having a circular end plate from which a first end wrap extends into the interior of said housing, an orbiting scroll having a circular end plate from which a second wrap extends, said first and second wraps interfitting at an angular and radial offset to form a plurality of line contacts which define at least one pair of sealed off fluid pockets, a driving mechanism operatively connected to said orbiting scroll to effect the orbital motion of said orbiting scroll, rotation preventing means for preventing the rotation of said orbiting scroll during orbital motion to thereby change the volume of the fluid pockets and a discharge chamber associated with said fluid outlet port and located adjacent one of said circular end plates on a side opposite its respective wrap to receive compressed fluid from a central fluid pocket formed by said scrolls during orbital motion, the improvement comprising:

at least one pair of holes formed through said circular end plate of one of said scrolls to form a fluid channel between the pair of sealed off fluid pockets and an intermediate pressure chamber located on the opposite side of said circular end plate of said one scroll from its respective wrap and separated from said discharge chamber, said pair of holes being located at symmetrical locations along said respective wrap so the wrap of the other of said scrolls simultaneously crosses over both of said pair of holes during orbital motion of said orbiting scroll, a communication channel formed through said circular end plate of said one scroll and opening onto a suction passageway which forms a fluid channel between said intermediate pressure chamber and a suction chamber located on the same side of said circular end plate of said one scroll as its respective wrap, said suction passageway also formed between said inlet port and said suction chamber, first control means for selectively controlling the opening and closing of said communication channel between said intermediate pressure chamber and said suction chamber, and second control means operating in conjunction with the operation of said first control means for increasing the resistance of said scroll type fluid compressor to suction during the initial opening of said communication channel by said first control means to thereby adjust the compression ratio of said scroll type fluid compressor.

2. The scroll type compressor of claim 1 wherein said first control means comprises a pressure sensitive valve which operates in response to the discharge pressure in said discharge chamber.

3. The scroll type compressor of claim 1 wherein said first and second control means comprise a three-way valve having a first opening connected to said suction chamber through said communication channel, a second opening connected to said fluid inlet port and a third opening connected to said intermediate pressure chamber.

4. The scroll type compressor of claim 3 wherein said three-way valve comprises a cylinder formed to include said first, second and third openings and a fourth opening connected to said discharge chamber by a capillary tube, an I-shaped piston slidably disposed within said cylinder and a spring disposed between the lower end surface of said piston and the bottom surface of said cylinder to push said piston toward the upper portion of said cylinder.

5. The scroll type compressor of claim 4 wherein said three-way valve further comprises magnetic valve means associated with the capillary tube between said discharge chamber and said fourth opening for closing said capillary tube.

* * * * *

UNITED STATES PATENT AND TRADEMARK OFFICE

CERTIFICATE OF CORRECTION

PATENT NO. : 4,642,034

DATED : February 10, 1987

INVENTOR(S) : Kiyoshi Terauchi

It is certified that error appears in the above-identified patent and that said Letters Patent is hereby corrected as shown below:

In claim 1, line 4, after "first" delete "end".

Signed and Sealed this

Seventeenth Day of November, 1987

*Attest:*

DONALD J. QUIGG

*Attesting Officer*

*Commissioner of Patents and Trademarks*